US007832131B2

(12) United States Patent
Thollin

(10) Patent No.: US 7,832,131 B2
(45) Date of Patent: Nov. 16, 2010

(54) AFTERGLOWING SIGN

(75) Inventor: Sven Thollin, Staffanstorp (SE)

(73) Assignee: System-Text AB, Malmö (SE)

( * ) Notice: Subject to any disclaimer, the term of this patent is extended or adjusted under 35 U.S.C. 154(b) by 559 days.

(21) Appl. No.: 10/592,127

(22) PCT Filed: Feb. 24, 2005

(86) PCT No.: PCT/SE2005/000253

§ 371 (c)(1),
(2), (4) Date: Sep. 8, 2006

(87) PCT Pub. No.: WO2005/106827

PCT Pub. Date: Nov. 10, 2005

(65) Prior Publication Data

US 2007/0193090 A1 Aug. 23, 2007

(30) Foreign Application Priority Data

Apr. 30, 2004 (SE) ..... 0401118

(51) Int. Cl.
*G09F 13/20* (2006.01)

(52) U.S. Cl. ..... 40/542; 428/690

(58) Field of Classification Search ..... 40/542
See application file for complete search history.

(56) References Cited

U.S. PATENT DOCUMENTS

| | | | | |
|---|---|---|---|---|
| 1,258,590 | A * | 3/1918 | Meyer | 40/542 |
| 3,591,942 | A | 7/1971 | Swearingen | |
| 4,151,667 | A | 5/1979 | Idelson | |
| 4,500,116 | A | 2/1985 | Ferro et al. | |
| 5,414,947 | A | 5/1995 | Hjaltason | |
| 5,433,807 | A | 7/1995 | Heckenkamp et al. | |
| 5,698,301 | A | 12/1997 | Yonetani | |
| 6,048,595 | A | 4/2000 | Nakajima et al. | |
| 6,074,739 | A | 6/2000 | Katagiri | |
| 6,076,294 | A | 6/2000 | Durbin | |
| 6,131,322 | A | 10/2000 | Hjaltason | |
| 6,210,776 | B1 | 4/2001 | Hill | |
| RE37,186 | E | 5/2001 | Hill | |
| 6,375,864 | B1 | 4/2002 | Phillips | |
| 6,395,408 | B1 | 5/2002 | Nelson | |
| 6,505,554 | B1 | 1/2003 | Rhein | |
| 6,534,163 | B1 | 3/2003 | Takatsu | |
| 6,656,566 | B1 | 12/2003 | Kuykendall | |
| 2002/0119294 | A1 * | 8/2002 | Monkarsh et al. | 428/195 |
| 2004/0055483 | A1 | 3/2004 | Thollin | |

FOREIGN PATENT DOCUMENTS

| | | |
|---|---|---|
| DE | 295 02 699 | 7/1996 |
| DE | 296 10 580 U1 | 9/1996 |
| FR | 897807 | 4/1945 |
| GB | 2 034 503 | 6/1980 |
| GB | 2 109 606 | 6/1983 |

(Continued)

*Primary Examiner*—Joanne Silbermann
(74) *Attorney, Agent, or Firm*—Buchanan Ingersoll & Rooney PC

(57) ABSTRACT

The present invention relates to an afterglowing sign printed with afterglowing pigments. The sign is made of a material with a coloured surface on which the afterglowing pigment is printed, and the coloured substrate shines through the print with the afterglowing pigment.

19 Claims, 3 Drawing Sheets

FOREIGN PATENT DOCUMENTS

| | | | |
|---|---|---|---|
| GB | 147 542 | A | 5/1985 |
| GB | 2 332 081 | A | 6/1999 |
| HU | 218403 | | 9/1992 |
| HU | P0200108 | | 1/2002 |
| JP | 5-031980 | U | 4/1993 |
| JP | 07-287541 | | 10/1995 |
| JP | 09-300517 | | 5/1996 |
| JP | 09-031369 | | 2/1997 |
| JP | 10-056578 | A | 2/1998 |
| JP | 10-171392 | | 6/1998 |
| JP | 2000-079751 | | 3/2000 |
| SE | 519 842 | C2 | 4/2003 |
| WO | WO 93/07605 | | 4/1993 |
| WO | WO 96/29692 | | 9/1996 |
| WO | WO 97/12646 | | 4/1997 |
| WO | WO 97/15453 | A1 | 5/1997 |

* cited by examiner

AFTERGLOWING SIGN

FIELD OF THE INVENTION

The present invention relates to an afterglowing sign printed with afterglowing pigments.

BACKGROUND ART

In the case of danger, alarm, fire, smoke formation, threats etc, the presence of clearly visible signs on premises is extremely important, for example for indicating the nearest escape route or the location of fire extinguishing equipment, gas cylinders and emergency stops. According to the colour requirements stipulated by the appropriate authority, such safety signs should have one or more white or black, standardised symbols on a red, green or yellow background.

Some of the existing afterglowing safety signs are used, inter alia, to indicate and display escape routes and emergency exits and to indicate the location of fire extinguishing equipment. However, the afterglowing pigments used do not exist in the colour shades needed to obtain an optimal colour reproduction, in normal printing, both in daylight and, with a coloured afterglow, in the dark. The solution to this problem has so far been to accept that these signs show afterglowing symbols only in the dark, in which case their background colour has been perceived as black. Thus, the colour requirements for these afterglowing safety signs are met only in daylight and in lit spaces since the afterglowing pigments available do not completely fulfil the requirements both in daylight/lit spaces and in the dark.

It is also known from SE 0100615-4 to use afterglowing signs printed with afterglowing pigments, which are coated with a screen print using opaque or transparent ink to provide, for instance, safety signs which fulfil the colour requirements both in daylight/lit spaces and, with a coloured afterglow, in the dark. When taking a close look at these signs, they can produce a disturbing impression owing to the screen print, for instance a striped, checked or dotted visual impression. Signs with a screen print may also give the impression of a slightly different colour shade in relation to standard because of the effect of the screen pattern on the visual impression. Especially in the case of safety signs where standardised colour shades and surfaces are used, it is thus desirable to come as close as possible to a homogeneously coloured impression, and reproduce the colour shades as correctly as possible.

SUMMARY OF THE INVENTION

An object of the present invention therefore is to provide an afterglowing sign which affords an optimal colour reproduction both in daylight and, with a coloured afterglow, in the dark. This object is achieved by the afterglowing sign being printed with a transparent print of afterglowing pigments, coloured or white/yellowish-white, on a coloured background such as a coloured sign material, so that the colour of the substrate shines through the afterglowing print. Since the colour of the substrate shines through the afterglowing ink, a correct colour reproduction is provided in daylight and in lit spaces. The shade of the afterglowing ink, with a coloured afterglow in the dark, is also affected by the coloured substrate so that the shade in the dark will be more equal to the shade in daylight or in lit spaces.

Another object of the invention is to provide an afterglowing sign which produces an excellent visual impression to prevent disturbing impressions that can be caused by screen printing. On certain conditions, it can be a great advantage not to produce using screen print, for instance small-size signs where the viewing distance is short. In such cases, the screen print can be experienced as disturbing to the viewer of the sign. This object is achieved by the afterglowing sign being printed with an opaque ink and a transparent print of afterglowing pigments.

In a preferred embodiment of the sign, a sign material having a coloured surface is used, and the colour on this surface shines through the print with afterglowing pigments.

In another preferred embodiment of the sign, the coloured surface of the sign is provided by printing with opaque ink on the sign material.

In yet another preferred embodiment of the sign, the ground colour of the sign is provided by printing an opaque ink and symbols and borders by printing another opaque ink on the sign material.

In another preferred embodiment of the sign, only surfaces with the ground colour of the sign have been coated with a print of afterglowing pigments.

In a further embodiment of the sign, surfaces with the ground colour of the sign have been coated with a print of an afterglowing pigment of one colour and symbols and borders have been coated with an afterglowing pigment of another colour.

In yet another preferred embodiment of the sign, surfaces with the ground colour of the sign and symbols and borders have been coated with the same afterglowing pigment.

In a further preferred embodiment of the sign, symbols and borders have been applied to the print with afterglowing pigment, which symbols and borders have then in turn been coated with afterglowing print.

In yet another preferred embodiment of the sign, the afterglowing pigments used in the print over the ground colour are white/yellowish-white, yellow, red and/or green.

In another preferred embodiment of the sign, the afterglowing pigments used in the print over the ground colour are white/yellowish-white.

In yet another preferred embodiment of the sign, the coloured surface of the sign material has the same shade as the used afterglowing pigment.

In yet another preferred embodiment of the sign, symbols and borders are printed with black opaque ink on the coloured sign surface with afterglowing pigment.

In another preferred embodiment of the sign, a contour recess is formed in the afterglowing ground surface around symbols and/or the border printed on the sign, to increase the contrast between symbols and background in the dark.

In yet another preferred embodiment of the sign, a contour has been created, arranged in symbols and/or on the border, by printing an opaque ink or by avoiding printing an afterglowing ink on the contour area.

The sign is made of metal, plastic or composite in one embodiment, and of a coloured transparent or translucent material in another embodiment.

The above objects are also achieved by a method, in which the afterglowing sign is printed with an opaque ink and a transparent print of afterglowing pigments.

In a preferred method according to the present invention, the afterglowing pigment is applied to a sign material having a coloured surface, and the colour on the same shines through the print with afterglowing pigment.

In another preferred method, the coloured surface of the sign is provided by being coated with an opaque ink on the sign material.

In yet another preferred method, the ground colour of the sign is provided by being printed with an opaque ink, and symbols and borders by being printed with another opaque ink.

In yet another preferred method, only surfaces with the ground colour of the sign are coated with a print of afterglowing pigments.

In another preferred method, surfaces with the ground colour of the sign are coated with a print of afterglowing pigment of one colour and symbols and borders are coated with an afterglowing pigment of another colour.

In yet another preferred method, surfaces with the ground colour of the sign and symbols and borders are coated with the same afterglowing pigment.

In yet another preferred method, symbols and borders are printed on the print with afterglowing pigment, which symbols and borders are then in turn coated with afterglowing print.

In another preferred method, the afterglowing pigments used in the print over the ground colour are white/yellowish-white, yellow, red and/or green.

In yet another preferred method, the afterglowing pigments used in the print over the ground colour are white/yellowish white.

In another preferred method, symbols and borders are printed with black opaque ink on the coloured sign surface with afterglowing pigment.

In another preferred method, the coloured surface of the sign material has the same shade as the used afterglowing pigment.

In yet another preferred method, a contour recess is formed in the afterglowing ground surface around symbols and/or the border printed on the sign.

In yet another preferred method, a contour is created, arranged in symbols and/or on the border, by printing an opaque ink or by avoiding printing an afterglowing ink on the contour area.

In another preferred method, the sign is made of metal, plastic or composite.

In yet another preferred method, the sign is made of a coloured transparent or translucent material.

BRIEF DESCRIPTION OF THE DRAWINGS

The invention will now be described in more detail by way of preferred embodiments and with reference to the accompanying drawings.

DESCRIPTION OF PREFERRED EMBODIMENTS

Figure 1:
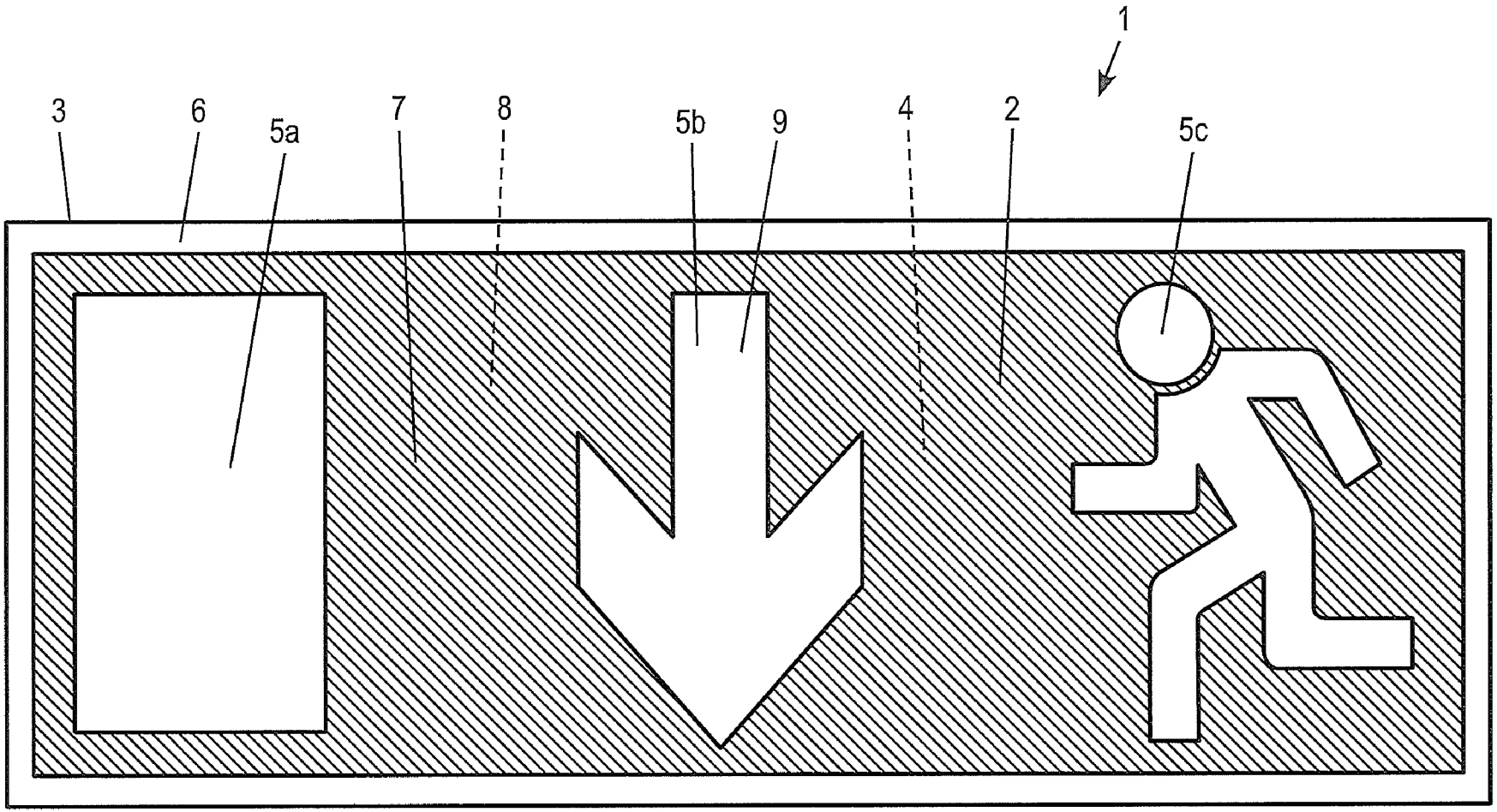
FIG. 1 illustrates a sign according to the invention, a green bottom being coated with a coloured afterglowing print and symbols and borders being printed with a white opaque ink with a white/yellowish-white afterglowing print.
Figure 2:
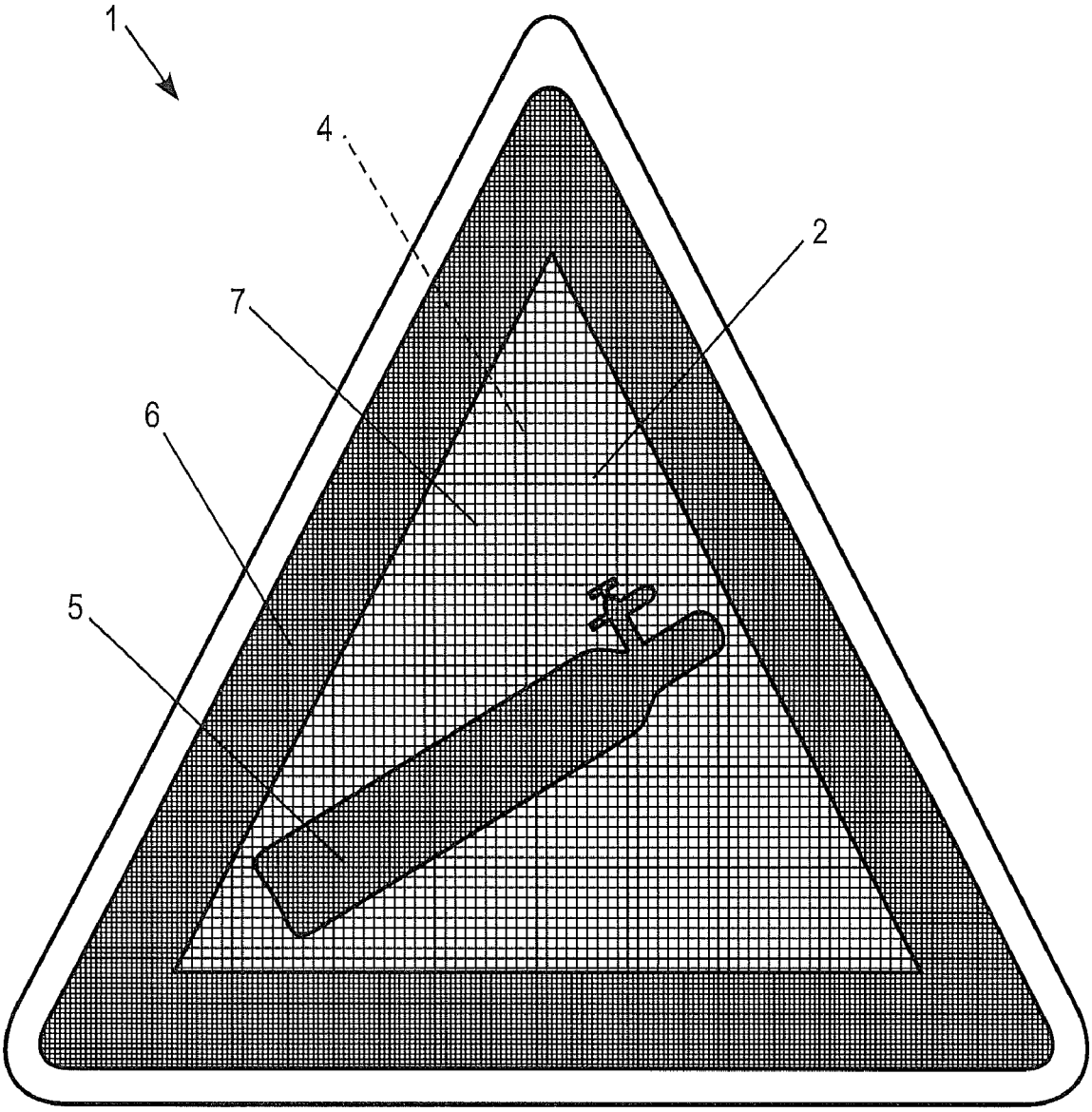
FIG. 2 illustrates a sign according the invention, a yellow bottom being coated with a coloured afterglowing print and symbols and borders being printed with black opaque ink.

FIGS. 1 and 2 illustrate two preferred signs 1 according to the present invention. FIG. 1 shows an escape route sign 1, which, according to standard, has a green background area 7 and symbols 5*a-c* and border 6 in white. FIG. 2 illustrates a warning sign 1 for gas cylinders, which, according to standard, has a yellow background area 7 and symbol 5 and border 6 in black.

One embodiment for FIG. 1 is to print a sign 1, of sign material 3 with a green background surface 4, coated with a green afterglowing print 2 over the entire background surface 4. On this, symbols 5*a-c* and a border 6 have then been printed with a white opaque ink, which are then in turn coated with a white/yellowish-white afterglowing print 9.

Another embodiment for FIG. 1 is to print on a sign material 3, with a background surface 4, a background area print 8 of an opaque green ink on the surfaces which are to be the background area 7 and a white opaque ink for symbols 5*a-c* and border 6. The surface with the background area print 8 of a green opaque ink is coated with a green afterglowing print 2 and the symbols 5*a-c* and border 6 are then coated with a white/yellowish-white afterglowing print 9. It is also possible to use one and the same afterglowing pigment over the surface that is to be afterglowing, i.e. both background area print 8 and symbols 5*a-c* as well as border 6; since the colour behind shines through, the sign 1 is then experienced to have its correct colours.

Another embodiment for FIG. 1 is to print a background area print 8 of an opaque green ink on a white material 3 with recesses (not shown) for symbols 5*a-c* and border 6. The surface with the background area print 8 of a green opaque ink is coated with a green afterglowing print 2. The symbols 5*a-c* and border 6 are then in turn coated with a white/yellowish-white afterglowing print 9.

FIG. 2 illustrates a sign 1 with a yellow background surface 4 coated with a white/yellowish-white afterglowing print 2 over the entire background surface 4. After that the symbols 5 and border 6 have been printed with black opaque ink on this background surface 4.

Figure 3:
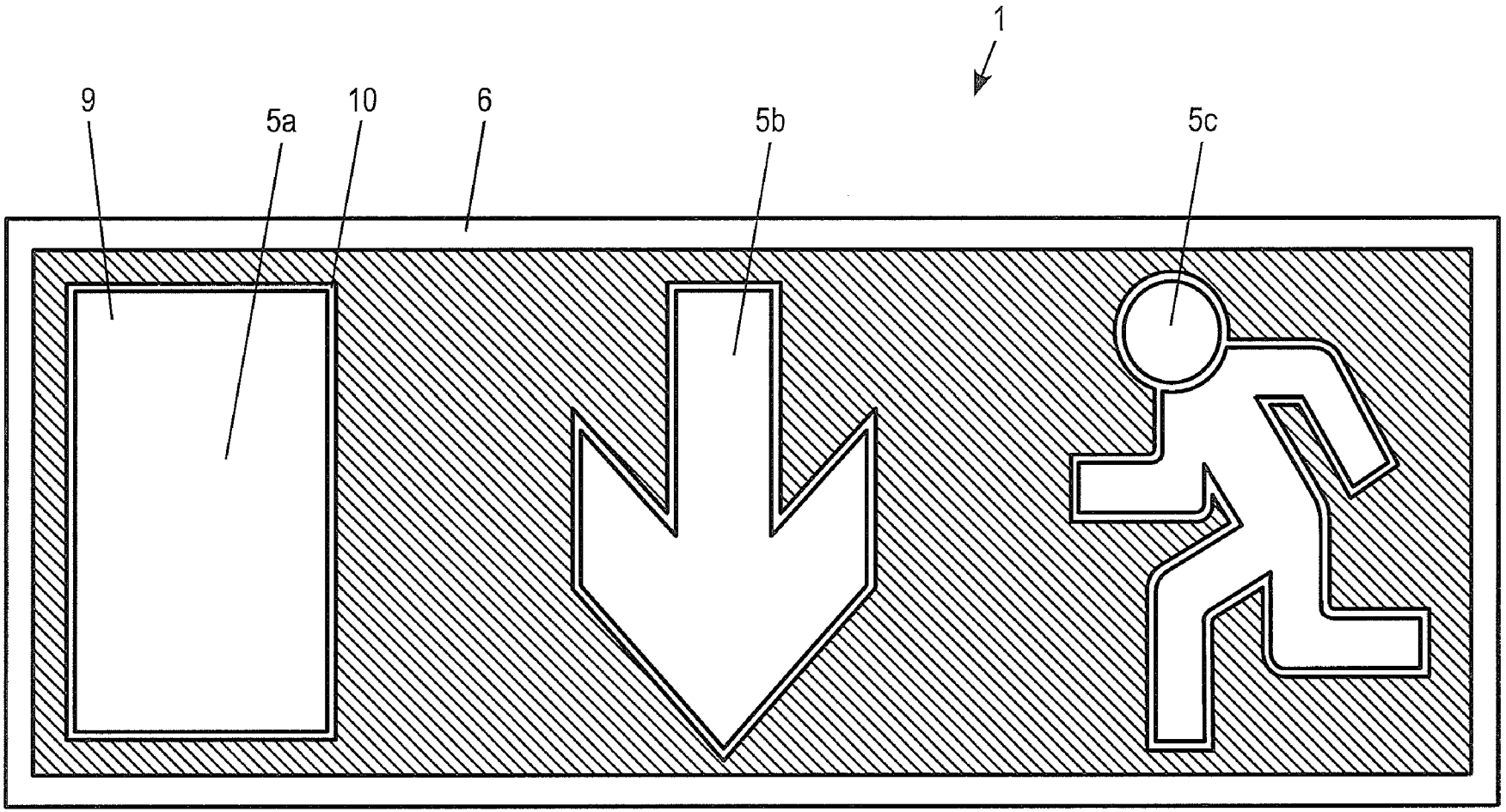
FIG. 3 is a schematic view of a sign according to the invention, in which a contour recess is formed in the afterglowing surface around the symbols.

An embodiment for FIG. 3 is to print the border 6 and symbols 5*a-c* with a white afterglowing print 9 on the white surfaces of a sign 1. For better contrasts, a white contour 10, without an afterglowing print, is left, which in the dark surrounds the symbols 5*a-c* with a black border since the contour is not afterglowing.

The signs are made of aluminium or plastic and are silk screen printed. Any type of afterglowing pigments can be used; preferred but non-limiting pigments are $Mo.Al_2O_3$: doped with Eu as white/yellowish-white afterglowing pigment, (Ca0.8 Sr0.2)S—CaS as red afterglowing pigment and $Mo.Al_2O_3$:doped with Eu plus fluorescent green pigment as green afterglowing pigment.

The choice of the afterglowing pigment or the afterglowing ink is not decisive, but the afterglowing ink in combination with the surface ink of the sign should give the completed sign a background colour which is the same in daylight/lit spaces and, with a coloured afterglow, in the dark. The technical effect thus is not dependent only on the pigment or the ink used to obtain the afterglowing print, provided that the afterglowing ink is printed on a coloured surface which lets through its shade.

The afterglowing pigments are printed on the sign which has a coloured background. The coloured background can be, for instance, green, red or yellow. For the afterglowing pigments, preferably the same colour as for the substrate is used, for instance red or green, but for instance a white/yellowish-white pigment may have a similar effect due to the combination. A contour recess around the symbols and the border, with a width of about 1.5-3 mm, can also be made (see FIG. 3) when printing the afterglowing ground surface in order to increase the contrast between the background and the symbols/border in the dark.

The sign shown in FIG. 1, which is printed with green afterglowing ink on a green background, has a uniform green background colour in daylight/lit spaces, while at the same time it keeps this green colour with a coloured afterglow in the dark owing to the combination of the green sign substrate and the green afterglowing pigment.

It will be appreciated that modifications of the preferred embodiments described above are possible within the scope of the invention, as defined by the appended claims. For example, the afterglowing sign does not have to be an escape route sign or a sign indicating the location of fire extinguishing equipment, but may be of some other type, for instance a sign used for advertising purposes.

The invention claimed is:

1. An afterglowing sign comprising:

a print with at least one afterglowing pigment, a sign material comprising a background surface, the background surface comprising at least one symbol or border and a background area, the background area being a background area print of a colour on the background surface, the background area print defining a boundary of the at least one symbol or border, such that the at least one symbol or border is not part of the background area print, wherein the print with at least one afterglowing pigment is printed on the background area print, and wherein the color of the background area print shines through the print with at least one afterglowing pigment, the afterglowing sign further comprising one of the following features:

A) only the background area print is printed on with the print with at least one afterglowing pigment, such that the at least one symbol or border is not printed with any print with at least one afterglowing pigment;

B) the background area print is printed on with the print with at least one afterglowing pigment, which has a first color, and the at least one symbol or border is printed with a second print with at least one afterglowing pigment, which has a second color, the first color being different from the second color, wherein the color of the at least one symbol or border shines through the second print with at least one afterglowing pigment; or C) the at least one symbol or border and the background area print both being printed on by the same print with at least one afterglowing pigment.

2. An afterglowing sign as claimed in claim 1, wherein the background area print is a printing with opaque ink on the sign material.

3. An afterglowing sign as claimed in claim 1, wherein the background area print is a printing with opaque ink and the at least one symbol or border is a printing of another opaque ink on the sign material.

4. An afterglowing sign as claimed in claim 1, wherein the at least one afterglowing pigment used in the print with at least one afterglowing pigment is white/yellowish-white, yellow, red and/or green.

5. An afterglowing sign as claimed in claim 4, wherein the at least one afterglowing pigment used in the print with at least one afterglowing pigment is white/yellowish-white.

6. An afterglowing sign as claimed in claim 1, wherein the sign is made of metal, plastic or composite.

7. An afterglowing sign as claimed in claim 1, wherein the sign is made of a coloured transparent or translucent material.

8. An afterglowing sign as claimed in claim 1, wherein the background area print has the same shade as the afterglowing pigment used in the print with at least one afterglowing pigment.

9. An afterglowing sign as claimed in claim 1, wherein a contour recess is formed in the background area around at least one symbol or border printed on the sign.

10. An afterglowing sign as claimed in claim 1, wherein a contour has been created, arranged in at least one symbol or border, by printing an opaque ink or by avoiding printing an opaque ink or by avoiding printing an afterglowing ink on the contour area.

11. A method for producing an afterglowing sign according to claim 1, the method comprising producing an afterglowing sign comprising:

a print with at least one afterglowing pigment, a sign material comprising a background surface, the background surface comprising at least one symbol or border and a background area, the background area being a background area print of a colour on the background surface, the background area print defining a boundary of the at least one symbol or border, such that the at least one symbol or border is not part of the background area print, wherein the print with at least one afterglowing pigment is printed on the background area print, and wherein the color of the background area print shines through the print with at least one afterglowing pigment, the afterglowing sign further comprising one of the following features:

A) only the background area print is printed on with the print with at least one afterglowing pigment, such that the at least one symbol or border is not printed with any print with at least one afterglowing pigment;

B) the background area print is printed on with the print with at least one afterglowing pigment, which has a first color, and the at least one symbol or border is printed with a second print with at least one afterglowing pigment, which has a second color, the first color being different from the second color, wherein the color of the at least one symbol or border shines through the second print with at least one afterglowing pigment; or C) the at least one symbol or border and the background area print both being printed on by the same print with at least one afterglowing pigment.

12. An afterglowing sign as claimed in claim 1, wherein the print with at least one afterglowing pigment is transparent.

13. An afterglowing sign as claimed in claim 1, wherein the afterglowing pigment used in the print with at least one afterglowing pigment has a coloured afterglow and the shade of the coloured afterglow is affected by the background area print.

14. An afterglowing sign as claimed in claim 1, wherein only the background area print is printed on with the print with at least one afterglowing pigment, such that the at least one symbol or border is not printed with a print with at least one afterglowing pigment.

15. An afterglowing sign as claimed in claim 1, wherein the background area print is printed on with the print with at least one afterglowing pigment, which has a first color, and the at least one symbol or border is printed with a second print with at least one afterglowing pigment, which has a second color, the first color being different from the second color, wherein the color of the at least one symbol or border shines through the second print with at least one afterglowing pigment.

16. An afterglowing sign as claimed in claim 1, wherein the at least one symbol or border and the background area print both being printed on by the same print with at least one afterglowing pigment.

17. An afterglowing sign as claimed in claim 1, wherein the at least one symbol border is not formed by a printing of an opaque ink, but instead is only formed by being an area of the background surface not having the printing of a colour on the background surface.

18. An afterglowing sign comprising:

a first print with at least one afterglowing pigment, a sign material comprising a background surface, the background surface comprising at least one symbol or border and a background area, the background area being a background area print of a colour on the background surface, wherein the first print with at least one afterglowing pigment is printed on the background area print, and wherein the color of the background area print shines through the first print with at least one afterglowing pigment, wherein the at least one symbol or border is a symbol or border print on the first print with at least one afterglowing pigment, and wherein a second print with at least one afterglowing pigment is printed on the symbol or border print.

19. An afterglowing sign as claimed in claim 18, wherein the at least one symbol or border is printed with black opaque ink on the background area print with afterglowing pigment.

* * * * *